United States Patent [19]

Fleury

[11] Patent Number: 4,549,112

[45] Date of Patent: Oct. 22, 1985

[54] DELAY LINE FOR A TRAVELLING WAVE TUBE

[75] Inventor: Georges Fleury, Paris, France

[73] Assignee: Thomson-CSF, Paris, France

[21] Appl. No.: 450,521

[22] Filed: Dec. 17, 1982

[30] Foreign Application Priority Data

Dec. 22, 1981 [FR] France ..... 81 23956

[51] Int. Cl.[4] ..... H01J 25/34

[52] U.S. Cl. ..... 315/3.6; 315/39.3

[58] Field of Search ..... 315/3.6, 39.3

[56] References Cited

U.S. PATENT DOCUMENTS

| | | | |
|---|---|---|---|
| 2,814,779 | 11/1957 | Mendel | 315/3.6 X |
| 2,890,373 | 6/1959 | Chodorow | 315/3.6 |
| 2,927,832 | 3/1960 | Marchese | 315/3.6 |
| 3,088,105 | 3/1963 | Beam | 315/3.6 |
| 3,289,032 | 11/1966 | Rubert et al. | 315/3.6 |
| 3,292,033 | 12/1966 | Kenmoku | 315/3.6 |
| 3,349,278 | 10/1967 | Huse, Jr. | 315/3.6 |
| 3,571,651 | 10/1970 | Wilbur | 315/3.6 |
| 3,614,516 | 10/1971 | Phillips | 315/3.6 |
| 3,716,745 | 2/1973 | Phillips | 315/3.6 |
| 3,886,397 | 5/1975 | Hiramatsu | 315/3.6 |

OTHER PUBLICATIONS

Funkschau, vol. 48, No. 22, Oct. 1976, pp. 56–58, J. Bretting, Wanderfeldröhren-Verstärker.

*Primary Examiner*—Saxfield Chatmon

*Attorney, Agent, or Firm*—Roland Plottel

[57] ABSTRACT

A delay line is provided for a travelling wave tube and comprising two parts:

a first part formed from a delay line section comprising a central conductor mounted in a cylindrical sleeve by means of dielectric rods. This first part is situated on the high frequency input side of the tube and is focussed by means of a succession of permanent magnets with alternate orientations;

a second part, following the first one which is formed from an entirely metal delay line section and which is focussed by means of a solenoid or a permanent magnet.

5 Claims, 1 Drawing Figure

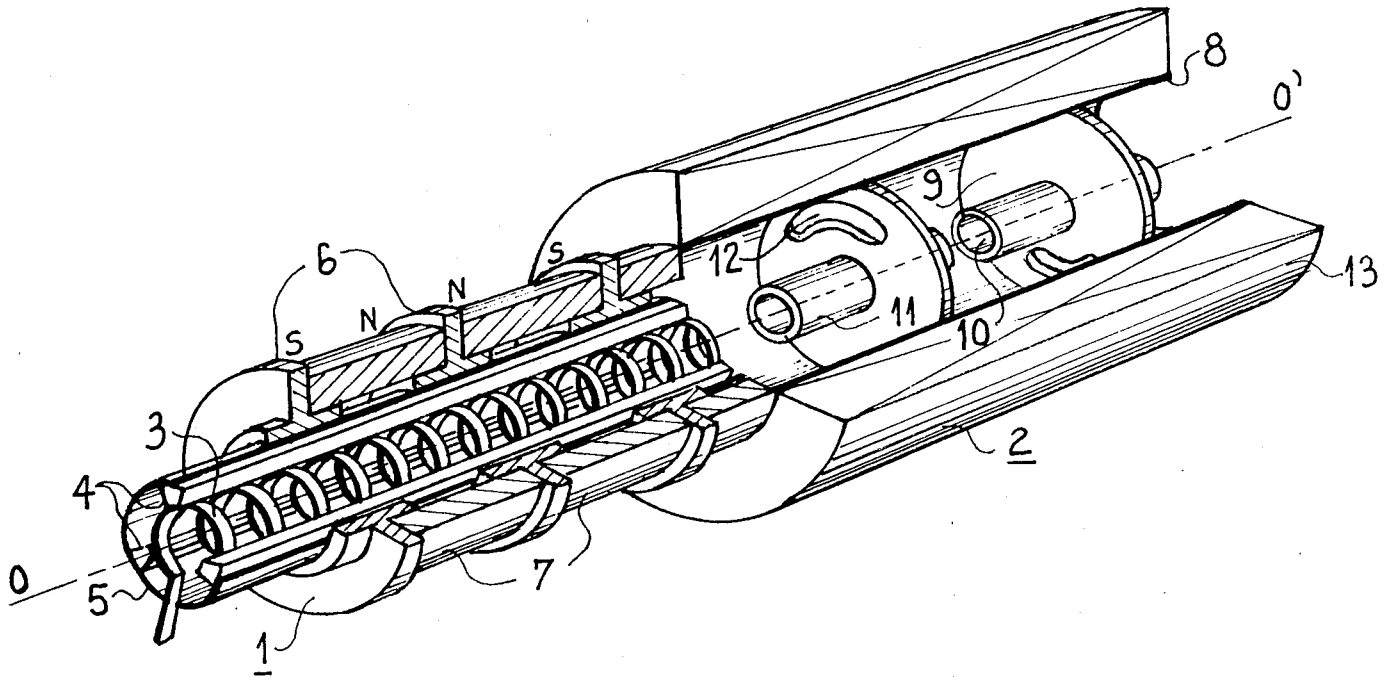
13
O'
8
2
10
9
11
12
S
N
N
S
7
6
1
3
4
5
O

DELAY LINE FOR A TRAVELLING WAVE TUBE

BACKGROUND OF THE INVENTION

The present invention relates to a delay line for a travelling wave tube.

It is known that, in these tubes, the delay line ensures interaction between an electron beam which is focussed along the axis of the line and an electromagnetic wave which is propagated along the line. When the conditions of synchronism of the wave and of the beam are achieved, the electrons give up energy to the electromagnetic wave.

Two types of delay line are known which are:

entirely metal delay lines such for example as coupled cavity lines or ceiling and ring lines;

delay lines comprising a central conductor mounted in a cylindrical sleeve by means of dielectric rods, such for example as helical lines of the "ring and bar" type and the "ring and loop" type.

The problem which arises is that none of these types of delay lines gives entire satisfaction.

The delay lines comprising dielectric rods are more widely used than the entirely metal delay lines for:

their cost of production is lower;

their ultra high frequency characteristics are better, in particular, the pass-band and the coupling impedance are higher;

their small external diameter allows the beam to be focussed along the axis of the line by using a succession of permanent magnets with alternate orientations. This method of focussing the beam—by means of a periodic—permanent magnet structure or P.P.M.—is interesting because of the space saved, its lightness and its zero energy consumption.

The disadvantage of delay lines comprising dielectric rods is that:

these lines are not suitable when the peak power and the average power become great for their central conductor cannot sufficiently remove the heat produced by the electrons which it intercepts and the heat produced by Joule effect losses due to the electromagnetic wave;

moreover, the Applicant has noted that when the electrons of the beam are highly grouped together in packets, that is to say towards the end of the travelling wave tube, focussing of the beam, which is achieved by means of a succession of permanent magnets with alternate orientations, is disturbed, and all the more so since the electronic efficiency of the tube is high.

Entirely metal delay lines may be used without problems when the peak power and the mean power become high but they present drawbacks in so far as the following are concerned:

their cost of production;

their ultra high frequency characteristics;

their focussing which can only be achieved by means of a solenoid, for their external diameter is too great for the field created along the axis by a succession of permanent magnets, with alternate orientations, to be sufficient and the distance along which the magnetic field is to be created is too great for a single permanent magnet to be able to be used.

The present invention relates to a new delay line structure which resolves the problem arising with the two known types of delay line.

SUMMARY OF THE INVENTION

The present invention relates to a delay line for a travelling wave tube which comprises two parts:

a first part, formed from a delay line section comprising a central conductor mounted in a cylindrical sleeve by means of dielectric rods. This first part, situated on the high frequency input side of the tube is focussed by a succession of permanent magnets, with alternate orientations;

a second part, following the first one, which is formed from an entirely metal delay line section and which is focussed by a focussing means other than a succession of permanent magnets with alternate orientations, namely by means of a solenoid or a permanent magnet.

It was not at all obvious that the transition between the two kinds of focussing means brings no problem such as bad shape for the magnetic fields or a too high induction on the pole pieces. The experiment shows that these problems are solved by modifying the size of the different elements of the focussing means.

DESCRIPTION OF THE DRAWING

Other objects, characteristics and results of the invention will be clear from the following description given by way of non limiting example and illustrated by the accompanying drawing which shows a perspective view of one embodiment of a delay line in accordance with the invention.

DESCRIPTION OF THE PREFERRED EMBODIMENT

In this figure, a delay line in accordance with the invention is shown comprising a first part 1 which is formed from a helical delay line section, this first part being followed by a second part 2 which is formed from a delay line section with coupled cavities.

The helical delay line section is situated on the high freuency input side of the tube. This section is formed from a central helical conductor 3, which is mounted in a cylindrical and vacuum tight sleeve 5, by means of rods 4 made from a dielectric material. Rods 4 may be brazed to the helix and to the sleeve, or be simply clamped between the helix and the sleeve.

Around sleeve 5 is mounted a device for focussing the electron beam along the axis of line 00'.

This focussing device is formed by a succession of permanent magnets 7, with alternate orientations, that is to say the faces of which bearing the same name (north or south) are facing each other. These permanent magnets are separated by polar masses 6 which are symmetrical in revolution about axis 00' and which have a T shaped cross section.

The delay line section with coupled cavities 2 follows the helical delay line section 1. It is formed by a metal cylinder 8 which contains disks 9, aligned parallel to each other along the axis 00' of the line. The disks form the wall common to two adjacent cavities. Each disk comprises a central opening 10 for the electron beam to pass therethrough around which the thickness of the disk is reinforced by a small cylinder 11, and a coupling opening between cavities 12 which is offset by 180° from one disk to the next.

Focussing of the electron beam along the axis of line 00' is provided by a device 13, which is shown symbolically in the figure, and which may be formed by a permanent magnet or by a solenoid. In fact, in the case of a delay line formed solely from coupled cavities, it is not possible to use a permanent magnet for focussing the beam for the interaction space is too long for the field created to be sufficient, unless the operating voltage is considerably increased. On the other hand, in the case of a delay line in accordance with the invention which only comprises one coupled cavity delay line section, it is possible, in some cases, to use a permanent magnet for focussing the beam for the distance along which the magnetic field is to be created is smaller.

The magnetic induction created along axis 00' by the two focussing devices used is first of all substantially sinusoidal because of the focussing by permanent magnets with alternate orientation, before becoming continuous.

The delay line of the invention is formed on the high frequency input side of the tube, as far as the first attenuator for example, by a helical delay line section, and from the last attenuator as far as the high frequency output of the tube by means of a coupled cavity delay line section.

It will of course be understood that the preceding description has been given in the case of a helical delay line section followed by a coupled cavity delay line section but that the invention relates more generally to a delay line comprising:

a delay line section comprising dielectric rods, situated on the high frequency input side of the tube and focussed by means of a succession of permanent magnets, with alternate orientations;

this section being followed by an entirely metal delay line section which is focussed by means of a solenoid or a permanent magnet.

A "ring and loop" or "ring and bar" line section may thus for example be associated with a line section having cavities coupled by loops. A preferred embodiment of the delay line of the invention comprises, situated on the high frequency input side of the tube, a helical line section of the "ring and bar" type or of the "ring and loop" type, which may be or not brased to the dielectric rods and which is focussed by means of a succession of permanent magnets, with alternate orientations, said section being followed by a ceiling and ring line section, which presents advantages from the bandwidth point of view.

With respect to an entierely metal delay line, the delay line of the invention allows:

a lower cost of production;

a reduced variation of gain in the passband and even a wider band;

a saving in space;

reduced consumption of the focussing device since it is possible not to use a solenoid at all.

With respect to a delay line comprising dielectric rods, the delay line of the invention allows operation with higher peak power and mean power and good focussing of the beam to be obtained even when the electrons are highly grouped together in packets.

What is claimed is:

1. A delay line for a traveling wave tube, comprising two parts:

a first part, formed from a helical derived delay line section comprising a central conductor mounted in a cylindrical sleeve by means of dielectric rods, this first part, situated on the high frequency input side of the tube being focused by means of a succession of permanent magnets with alternate orientations;

a second part, following the first one, having a metal slow wave circuit of the coupled cavity delay line type or of the ceiling and ring delay line type focused by a permanent magnet or solenoid other than a succession of permanent magnets with alternate orientations.

2. The delay line as claimed in claim 1, wherein the delay line section comprising dielectric rods has a helical structure.

3. The delay line as claimed in claim 1, wherein the delay line section has a structure of the "ring and bar" type.

4. The delay line as claimed in claim 1, wherein the delay line section has a structure of the "ring and loop" type.

5. The delay line as claimed in claim 1, wherein the first part is formed from a delay line section of the "ring and bar" type and the second part is formed from a ceiling and ring delay line section, focussed by a solenoid.

* * * * *